US008066363B2

(12) United States Patent
Greer et al.

(10) Patent No.: US 8,066,363 B2
(45) Date of Patent: Nov. 29, 2011

(54) PRINTHEAD FILTER SYSTEMS AND METHODS FOR MANUFACTURING THE SAME

(75) Inventors: David Emerson Greer, Lexington, KY (US); David Amos Ward, Cynthiana, KY (US)

(73) Assignee: Lexmark International, Inc., Lexington, KY (US)

( * ) Notice: Subject to any disclaimer, the term of this patent is extended or adjusted under 35 U.S.C. 154(b) by 223 days.

(21) Appl. No.: 11/094,957

(22) Filed: Mar. 31, 2005

(65) Prior Publication Data

US 2006/0227182 A1 Oct. 12, 2006

(51) Int. Cl.
*B41J 2/175* (2006.01)
*B41J 2/14* (2006.01)

(52) U.S. Cl. ..... 347/93; 347/49

(58) Field of Classification Search ..... 347/85, 347/86, 87, 49, 93; 141/2, 18
See application file for complete search history.

(56) References Cited

U.S. PATENT DOCUMENTS 5,162,817 A * 11/1992 Tajika et al. ..... 346/140 R
5,537,136 A 7/1996 Brandon et al.
5,565,899 A 10/1996 Sugimoto et al.
5,576,749 A * 11/1996 Mochizuki et al. ..... 347/86
5,589,862 A * 12/1996 Ujita et al. ..... 347/87
5,781,213 A 7/1998 Ujita et al.
5,790,158 A * 8/1998 Shinada et al. ..... 347/86
5,841,453 A * 11/1998 Sasaki ..... 347/86
5,877,794 A * 3/1999 Takagi ..... 347/87
5,900,898 A 5/1999 Shimizu et al.
5,949,451 A * 9/1999 Takagi ..... 347/40
5,949,458 A 9/1999 Studholme
5,949,461 A * 9/1999 Jones et al. ..... 347/87
6,000,789 A 12/1999 Takagi et al.
6,015,210 A * 1/2000 Kanematsu et al. ..... 347/87
6,019,463 A 2/2000 Waseda
6,033,063 A 3/2000 Tomikawa et al.
6,042,224 A 3/2000 Oda et al.
6,059,403 A 5/2000 Burgin
6,062,684 A 5/2000 Sasaki
6,082,852 A 7/2000 Soga et al.
6,196,671 B1 3/2001 Breemes, Sr. et al.
6,196,673 B1 3/2001 Takahashi
6,234,619 B1 * 5/2001 Kiritake ..... 347/87
6,234,622 B1 5/2001 Liu et al.
6,244,697 B1 6/2001 Powers et al.
6,267,251 B1 7/2001 Sullivan
6,398,352 B1 6/2002 Morita
6,398,354 B1 6/2002 Lattuca et al.
6,419,350 B1 7/2002 Abe et al.
6,422,691 B2 7/2002 Kobayashi et al.
6,422,692 B2 7/2002 Yamazaki et al.
6,457,821 B1 10/2002 Liu et al.
6,460,984 B1 10/2002 Matsumoto et al.
6,572,214 B2 6/2003 Otis, Jr. et al.
6,592,215 B2 7/2003 Udagawa et al.
6,634,742 B2 10/2003 Owaki et al.

(Continued)

*Primary Examiner* — Anh T. N. Vo

(57) ABSTRACT

Ink delivery systems for an ink jet printer and methods for manufacturing the same. In an embodiment, the system comprises a separable ink tank, a printhead body having an opening, ink ejectors associated with the printhead body, and a retainer engaged with the tower portion of the printhead body and with an exit port of the ink tank. A filter is attached to least one of the printhead opening and the retainer, such as by insert molding or heat staking for example. A filter cover member, such as a wick or a septum for instance, is disposed adjacent the filter.

25 Claims, 6 Drawing Sheets

U.S. PATENT DOCUMENTS 6,644,796 B2 11/2003 Olsen
6,742,879 B2 6/2004 Jones et al.
6,742,880 B2 6/2004 Jones et al.
6,783,220 B2 8/2004 Ujita et al.
6,923,530 B2 8/2005 Anderson et al.

* cited by examiner

FIGURE #2:

PRINTHEAD FILTER SYSTEMS AND METHODS FOR MANUFACTURING THE SAME

TECHNICAL FIELD

The present invention relates generally to printheads, and more specifically to printhead filter systems and methods of manufacturing the same.

BACKGROUND

An ink jet printer typically includes a printhead and a carrier. The ink jet printhead can comprise a printhead body, nozzles, and corresponding ink ejection actuators, such as heaters on a printhead chip. The actuators cause ink to be ejected from the nozzles onto a print medium at selected ink dot locations within an image area. The carrier moves the printhead relative to the medium, while the ink dots are jetted onto selected pixel locations, such as by heating the ink at the nozzles.

In some such systems, the ink reservoir comprises a removable or separable tank, such that the tank can be separated from the printhead, and replaced or refilled, when the ink is low. The printhead components can then be re-used. In such ink tank systems, a separable fluid connection between the tank and the printhead body is needed, in contrast to systems where the printhead body is integral with the ink reservoir. The connection permits ink to flow to the nozzles from the tank, but is separable such that the ink tank can be removed when empty.

The printhead assembly can also include a filter within an ink passageway leading from the ink reservoir to the nozzles, for isolating any contaminants or debris from the ejectors and nozzles. The filter is typically swaged onto a tower or passage leading to the nozzles. However, when the tank is installed in this manner, the filter edges can rub against the tank entrance, thereby abrading the raw filter edges and creating the possibility that the filter becomes damaged, and allowing loose particles to reach the nozzles and create clogging issues.

In some manufacturing techniques, the sides of the filter are swaged onto the tower, and the filter edges are encapsulated in plastic. However, such a process can require tight tolerances for precise placement of the filter that are difficult to achieve and require significant manufacturing time. Swaging also can place cut edges of the filter inside a pocket during the swage operation, and in a position for any particles that shed from the filter edge to be pushed under the filter. Particles from the edges can then travel to the chip and clog the nozzles on the chip.

In addition, some designs do not protect the filter when the tank is removed, such that ink on the filter can dry out, or the filter can otherwise be damaged, prior to the installation of the replacement tank. The dried ink can permanently clog the filter and ruin the printhead.

Accordingly, improved ink tank connections, printhead filter systems and methods of manufacturing the same are desired.

SUMMARY OF THE INVENTION

According to one embodiment, an ink delivery system for an ink jet printer is provided comprising a printhead body, a filter, a retainer, a wick, and ink ejectors. The ejectors are associated with the printhead body. A tower portion of the printhead body defines an ink entrance passage that receives ink from an ink tank, and the ink ejectors are in fluid communication with the entrance passage. The retainer includes a printhead end and a tank end. The retainer is engaged with the tower portion of the printhead body at the printhead end, and is configured to engage an exit structure on an ink tank at the tank end. The filter is disposed between the ink tank and the entrance passage. Moreover, the wick is disposed adjacent the filter.

According to another embodiment, an ink delivery system for an ink jet printer is provided comprising an ink tank, a printhead body, a retainer, a filter, and a filter cover. The ink tank is configured to hold ink and includes an exit port configured to provide ink to a printhead. The printhead includes a printhead body having a tower portion defining an ink entrance passage that receives ink from the ink tank. The printhead body and ink tank are separable from one another. The printhead also includes ink ejectors, the ink ejectors receiving ink from the entrance passage. The retainer has a printhead end portion and a tank end portion, the retainer being engaged with the tower portion of the printhead body at the printhead end portion and with the exit port of the ink tank at the tank end portion. The retainer includes an inner passage extending from the tank end portion to the printhead end portion. A filter is attached to at least one of the tower portion and the retainer, and a filter cover member is disposed between the tank end portion and the filter. The filter cover member can comprise a wick or a septum for example.

According to another embodiment, a method of manufacturing a printhead assembly is provided. The method comprises placing a filter over a printhead opening to a printhead body such that an edge of the filter extends past an edge of the printhead opening, the printhead opening being in fluid communication with at least one printhead nozzle. The method further comprises placing a retainer having an inner passage on the printhead opening such that the inner passage is in fluid communication with the printhead opening, fusing the filter to at least one of the printhead opening and the retainer, and placing a cover in the retainer and adjacent the filter, such that the cover extends at least partially within the inner passage of the retaining member. The fusing operation can be conducted, for example, without swaging, and by using heat, such as by heat staking or insert molding. The cover can comprise a wick or a septum for example.

According to another embodiment, a method of manufacturing a printhead assembly is provided. The method comprises attaching a filter to at least one of the retaining member and the tower portion. The method further comprises placing the retainer on the printhead body, the body defining an ink flow passage to a printhead chip. Moreover, the method comprises engaging the retainer with a removable ink tank, the ink tank being separable from the printhead body, and the retainer providing a substantially sealed fluid passage between the ink tank and the printhead body.

BRIEF DESCRIPTION OF THE DRAWINGS

While the specification concludes with claims particularly pointing out and distinctly claiming the present invention, it is believed the same will be better understood from the following description taken in conjunction with the accompanying drawings in which:

DETAILED DESCRIPTION OF EXAMPLE EMBODIMENTS

Figure 1:
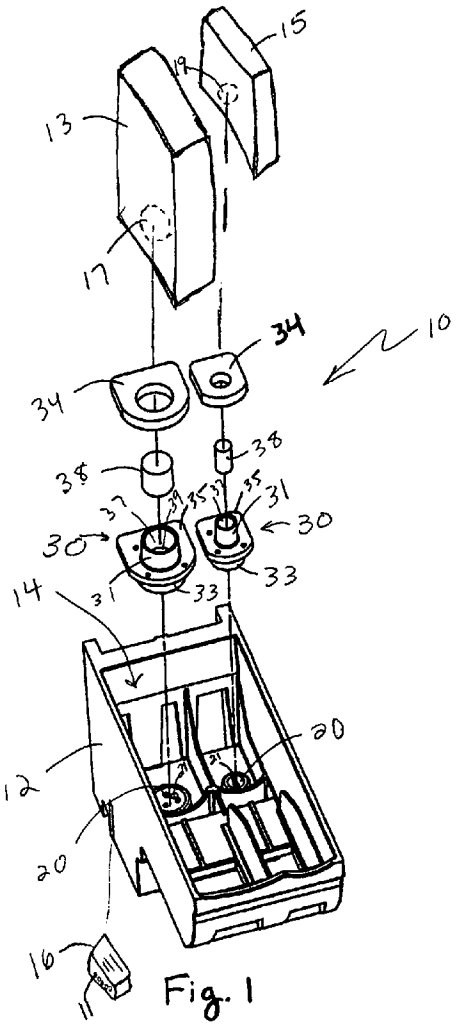
FIG. 1 is an exploded perspective view of an example embodiment of an ink delivery system having a filter and cover assembly, which is made and operates in accordance with principles of the present invention.
Figure 2:
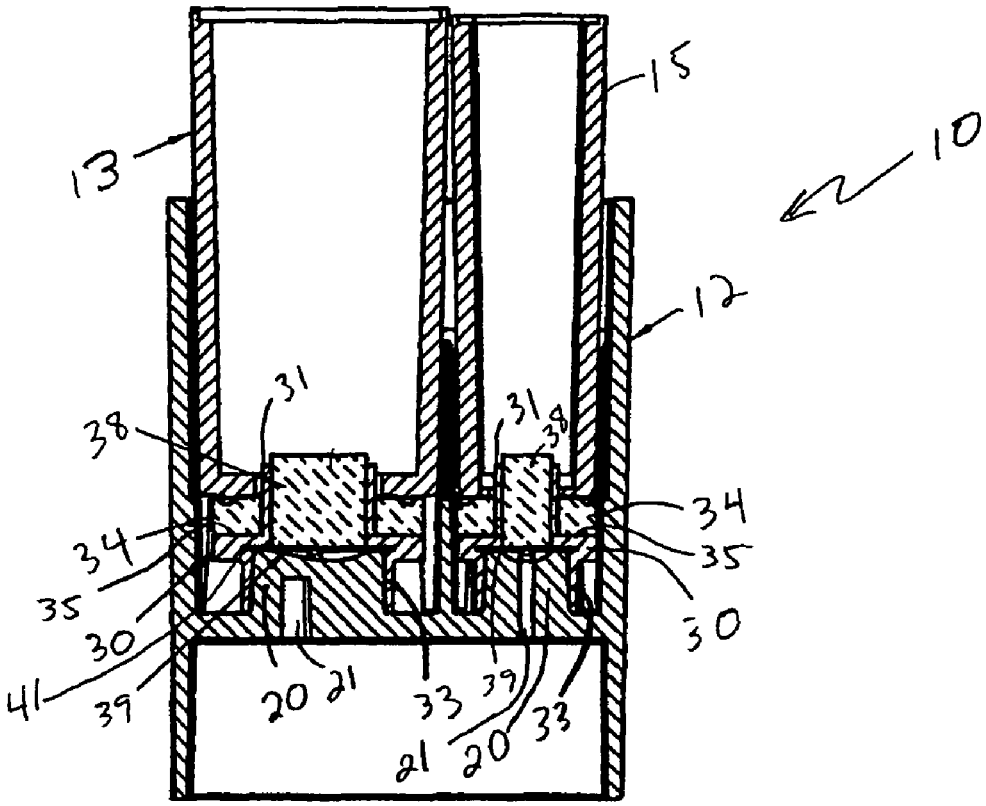
FIG. 2 is a cross sectional view of the example of FIG. 1.

With reference now to the figures, FIGS. 1 and 2 illustrate an example embodiment of an ink jet printer ink delivery system, which is made and operates in accordance with principles of the present invention. In particular, in this example, the system 10 includes a printhead including a printhead body 12 having a chamber 14 that is sized and configured to receive one or more ink tanks that are separable from the printhead. For example, an ink tank 13 for black ink can be received in the chamber 14, and an ink tank 15 for one or more color inks can be received in the chamber as well. The ink tanks includes exit ports 17/19 for delivery of the ink, once installed in the chamber 14, and these ports can include an interface structure as appropriate, such as a lip or extension. The exit ports 17/19 can be sealed using a removable seal, which can be removed at the time of installation. Each tank 13/15 can include a backpressure device, such as a felt or foam structure for example, to retain the ink during storage. The tanks 13/15 and the chamber 14 can comprise any of a variety of shapes and sizes, and the inks within the tanks can comprise a variety of types of ink, as appropriate to the type of printer at hand.

Attached to the printhead body 12 is a print head chip 16 including a plurality of nozzles 11 for delivery of the ink to the print medium. In other embodiments, the nozzles are provided on a structure separate from the chip 16. The ink flows from the exit ports 17/19 of the ink tanks 13/15 through channels in the lower portion of the body 12. The ink then flows within the body 12 to a manifold in the print head chip 16, from which it is drawn to nozzles 11 for ejection onto the print medium, such as by using heater elements or piezoelectric elements formed in the chip 16. The system 10 is moved relative to the print medium, such that the nozzles 11 drop ink at one or more desired locations on the medium.

In this example, the lower portion of the printhead body 12 includes towers 20 for each ink tank. The towers 20 can comprise any appropriate extension, structure, port, or interface for receiving ink for printing. The towers 20 of this example comprise raised tubular extensions, or standpipes, having one or more openings 21 through which the ink may flow. But other tower configurations are also possible as will be readily apparent to one of ordinary skill in the art.

Retainers 30 are also provided in this example, each engaging one of the tower portions 20. Each retainer 30 can comprise a conduit or guide component for providing a passage between the printhead body 12 and the ink tank 13/15. In this example, each retainer 30 includes an inner passage 37 for providing ink therethrough, the passage being defined by a smaller diameter upper pipe portion 31 on the tank end and a larger diameter lower pipe portion 33 on the printhead end. Near the middle of each retainer 30 is a ledge portion 35, which can comprise a lip, extension, or other surface.

The upper pipe portion 31 of each retainer 30 engages a corresponding exit port 17/19 of the tanks 13/15 allow ink to flow from the tanks to the passage 37 of the retainer. A sealing member 34 is disposed adjacent each retainer 30 and assists in sealing between the retainer and its corresponding ink tank 13/15. In this example, the sealing member comprises a gasket 34 that resides on the ledge 35 and includes an aperture that engages the upper pipe portion 31, so as to create a seal to control evaporative losses from the system. The gasket 34 can comprise a suitable elastomer material, or other material with good sealing properties.

In this example, each lower pipe portion 33 of each retainer 30 engages the corresponding towers 20 of the printhead body 12, to allow the ink to be provided to the towers. In some embodiments the lower pipe portion 33 and/or the towers 20 can be tapered to allow for a tightening fit as the pipe portion slides onto the tower. Each retainer 30 can comprise polypropylene or polyethylene, or other suitable material that can provide a fluid resistant seal against the tower 20, printhead body 12, and/or ink tanks 13/15.

Within each retainer 30 of this embodiment is provided a filter 39 for filtering contaminants in the ink from reaching the printhead chip 16. The filter 39 can also provide capillary functions to allow ink to pass upon demand to the printhead chip 16 and to prevent air passage into the printhead chip. The filter 39 can be made of a metal weave, a polymer weave, or other mesh, screen, or weave materials. For instance, a stainless steel dutch twill or a stainless steel random weave material could be utilized. In this embodiment, the filter 39 is molded within the material of the retainer 30. For example, an insert injection molding process may be utilized to form the retainer and internal filter 39. In particular, the retainer 30 can be formed by an injection molding machine which injects molten plastic into a mold cavity having the shape of the retainer. Prior to the molding process, the filter 39 is loaded into the mold robotically or manually at the desired position, the mold is closed, and the molten plastic injected into the mold cavity. Upon cooling, the mold is opened and the retainer 30 with internal filter 39 is removed. In other embodiments, the filter 39 can be insert injection molded in the printhead tower 20, or otherwise disposed in the printhead body 12. Such a molding process can reduce manufacturing time with respect to the filter and reduce the likelihood that portions of the filter 39 will break free and cause damage or clogging of the printhead. For example, encapsulating the edges 41 of the filter 39 in the retainer 30, such as by insert molding for instance, can reduce the risk that particles of the filter will break free. This process does not require swaging, crimping, rolling, or bending the filter edges 41 about the tower 20, and can be carried out without the need for a welding or staking tool.

A cover for the filter can also be provided, to protect the filter, to keep the filter moist, and to protect it from air and/or otherwise impede access to the filter from the tank side of the retainer 30, when the ink tank has been removed. In the example of FIGS. 1-2, the filter cover comprises a wick 38 which fits within the passage defined by the upper pipe portion 31 of the retainer 30. The wick 38 may comprise an absorbent sponge, fibrous material, polymer fiber (such as a polypropylene/polyethylene fiber blend), or other suitable wicking material, that is capable of transferring ink from the ink tank 13/15 to the filter 39. Alternatively, other protective filter covers may be used, such as the septum member described in further detail below with respect to another example embodiment.

To assemble the system of this embodiment of FIGS. 1-2, the filter 39 is encapsulated in the retainer 30, and the retainer is engaged with the tower 20 such as by pressing it onto the tower, so as to provide a fluid resistant seal therewith. The wick 38 is placed in the upper pipe portion 31 of the retainer, and the gasket 34 is slid onto the upper pipe portion. The exit port 17/19 on the ink tank 13/15 is engaged with the upper pipe portion 31, such as by sliding the tank 13/15 into engagement with the retainer 30. When the ink tank 13/15 is seated within the printhead body 12, the gasket 34 then provides a fluid resistant seal between the retainer 30 and the ink tank 13/15. During printing, ink moves from the tank 13/15 through the wick 38, retainer 30, printhead tower 20 and printhead body 12, to the printhead chip 16 where it is ejected through the nozzles 11 onto the medium. The assembly is moved relative to the medium, such as by moving the printhead body and/or the medium, and ink is ejected at selective locations on the medium using the ink ejectors on the printhead. When the ink tank 13/15 is removed from the assembly (e.g., after it is empty), the wick 38 protects the filter 39 and keeps it moist so that ink does not dry on the filter 39 and create clogging problems.

Figure 3:
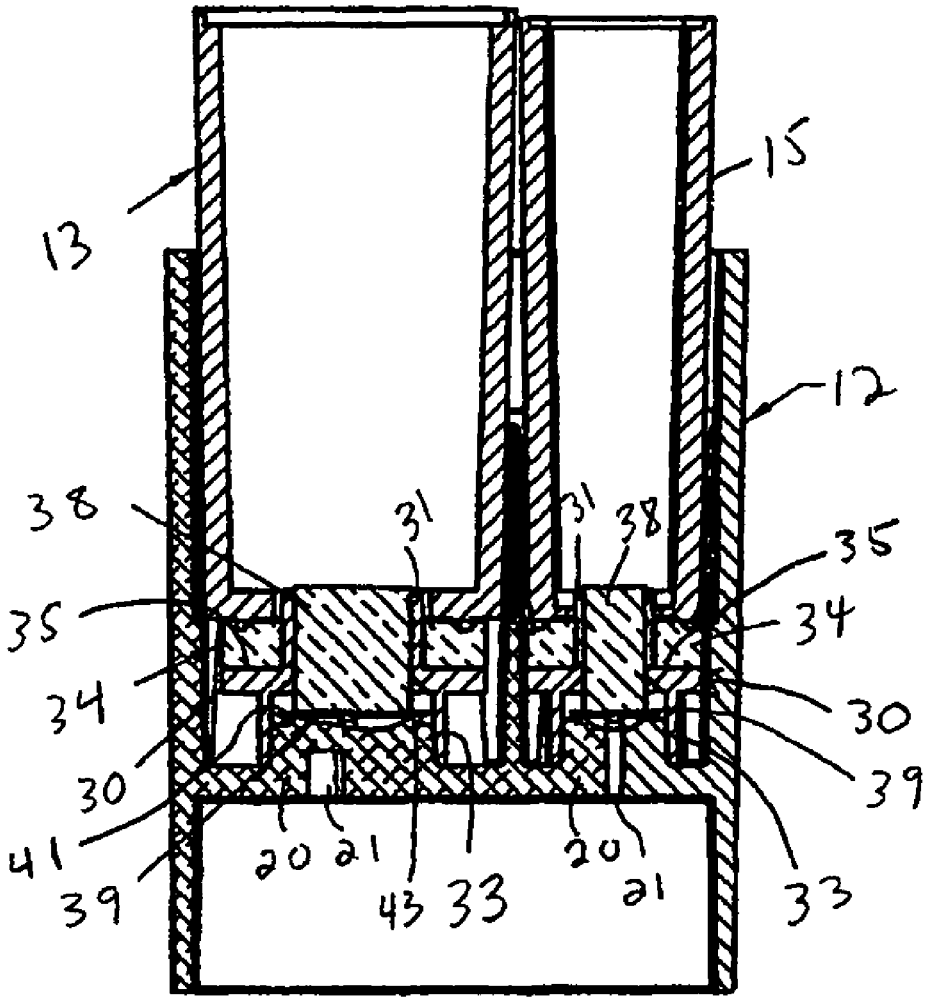
FIG. 3 is a cross sectional view of another example embodiment of an ink delivery system having a filter and cover assembly, which is made and operates according to principles of the present invention.

Other embodiments and configurations are also possible without departing from the principles of the inventions. For example, FIG. 3 is a cross sectional view of another embodiment of ink delivery system with a filter assembly, which is made and operates in accordance with a principle of the present inventions. In this example, many of the illustrative components are similar to those described above with respect to FIGS. 1-2, including removable tanks 13 and 15, wick 38, and gasket 34. Moreover, the retainer 30 is engaged with the tanks 13/15 (via upper pipe portion 31) and with the printhead body 12 (via lower pipe portion 33), and the gasket 34 and the wick 38 are held by the retainer. In particular, the gasket 34 surrounds the upper pipe portion 31 of the retainer 30 and the wick 38 is held within the retainer passage. However, the retainer 30 does not have a filter held within it in this example. Rather, the filter 39 is fused to the towers 20, which are slightly shorter in this example. Also, the wick 38 extends past the ledge 35 and contacts the filter 39 at the location of the tower 20. The operation of this system is similar to that of the previously-described embodiment.

To fuse the filter 39 to the tower 20, a heat staking process can be utilized. This process uses heat and pressure to reform the filter 39 into the tower 20 and thereby attach it thereto, without the need to swage, crimp, bend, or roll the edges of the filter about the tower. In other embodiments, the filter 39 is fused to the retainer 30 by heat staking. Other fusing methods may also be utilized, such as ultrasonic welding and heat sealing or attachment methods that do not require the filter edges to be swaged, bent, crimped or rolled. In an example heat staking process, a thermal tool or probe can transfer heat to the filter 39 and/or tower 20, to reset the memory of the plastic material that makes up the filter 39 and/or the tower 20. The temperature is high enough to soften the plastic. Force is provided by the tool to stake the filter 39 to the tower 20, by deflecting the material without damaging the plastic. Post cooling steps can also be utilized to cool the plastic. For example, cooling can be applied to the tip of the thermal tool at the end of the staking process.

As shown in the example of FIG. 3, the heat staking can be applied by placing the filter onto the tower 20 and using the thermal tool to force the edge regions 41 of the filter 39 directly onto the upper regions 43 of the tower 20 beneath the edge regions 41. When the retainer 30 is sealingly engaged with the tower 20, the outer edges of the filter are then held between the retainer 30 and the tower 20. Accordingly, the outermost peripheral edges of the filter 39 do not need to be swaged, crimped, rolled, or bent around the sides of the tower 20 in this process. Thus, the risk is reduced that portions of the side edges would enter a pocket of the tower and/or the ink channel 21. In placing the filter 39 on the tower 20 to commence the heat staking process, the raw cut edges of the filter 39 can hang outside of the lip of the tower 20, past the outside of an edge defining the printhead tower opening. Thus, the precise filter placement accuracy required in prior art designs is not required in this, and similar embodiments.

Figure 4B:
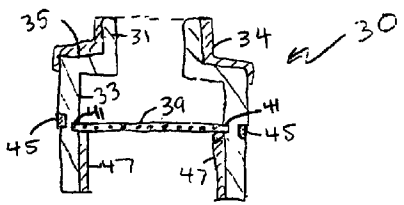
FIG. 4*b* is a cross-sectional view of the retainer shown in FIG. 4*a*, which is made and operates in accordance with principles of the present invention.
Figure 4A:
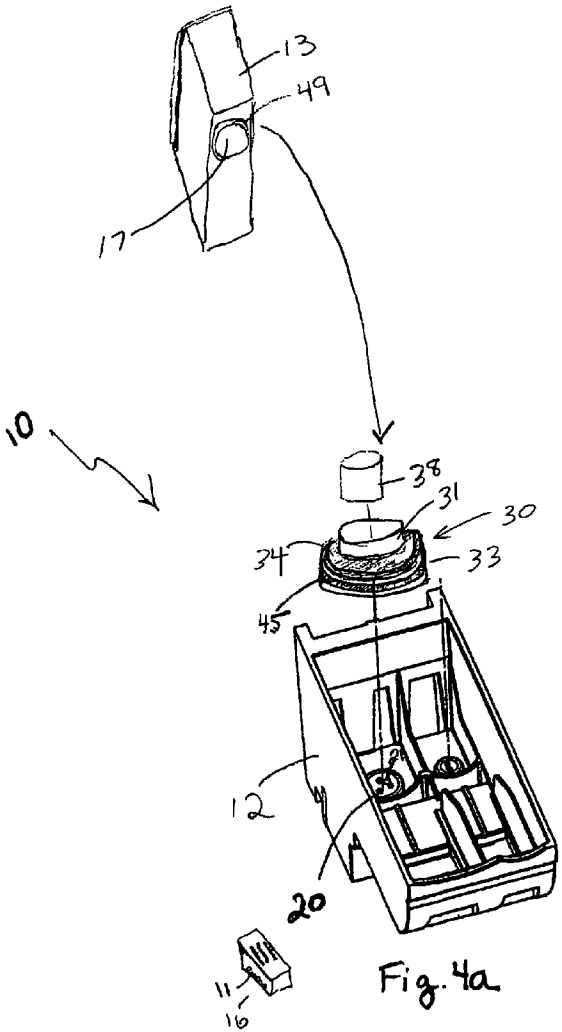
FIG. 4*a* is a perspective view of yet another example embodiment of an ink delivery system having a filter and cover assembly, which is made and operates in accordance with principles of the present invention.

FIG. 4*a* is a perspective view of yet another example embodiment of an ink delivery system 10 with a filter assembly, which is made and operates in accordance with a principle of the present invention. In this example embodiment, the retainer and gasket configuration is slightly different than the previous example embodiment. In particular, the upper portion 31 and lower portion 33 of the retainer 30 adjoin to form a ledge 35, upon which the gasket 34 rests. The gasket 34 in this example comprises an elastomer material bonded to the upper portion 31 of the retainer 30, and provided for sealing between the upper portion and a tower 49 extending from the ink tank 13. In addition, an additional gasket material is provided in this example, such as gasket 45 bonded within an exterior notch of the retainer 30 and gasket 47 bonded within the inner diameter of the lower portion 33. Gaskets 34, 45, and 47 can be overmolded or co-injected onto the retainer 30. Interior gasket 47 can provide a seal against the tower 20 when the retainer engages the printhead body 12, and exterior gasket 45 can provide an additional seal against the printhead body.

In this example, a filter 39 is encapsulated within the retainer 30, as best shown in FIG. 4*b* which is a cross-sectional view of the retainer. Here the edges 41 of the filter 39 are held within the retainer material, and this configuration can be formed by insert injection molding, for example. The filter 39 includes pores to allow ink to pass through the retainer 30.

To assemble the system, the retainer 30 and its encapsulated filter 39 is placed on the tower 20. The wick 38 is disposed in the top entrance of the retainer 30 and against the filter. And the replaceable ink tank 13 is disposed about the upper portion 31 of the retainer, such that the wick 38 extends in through the exit port 17 on the tank. In operation, ink from the tank 13 flows through the exit port 17 and wicks through the wicking material 38 to the filter 39, where contaminants are filtered out. The ink then proceeds to the passage 21 of the printhead tower 20, through the printhead body 12, and to the printhead chip 16 for ejection to the medium.

Figure 5A:
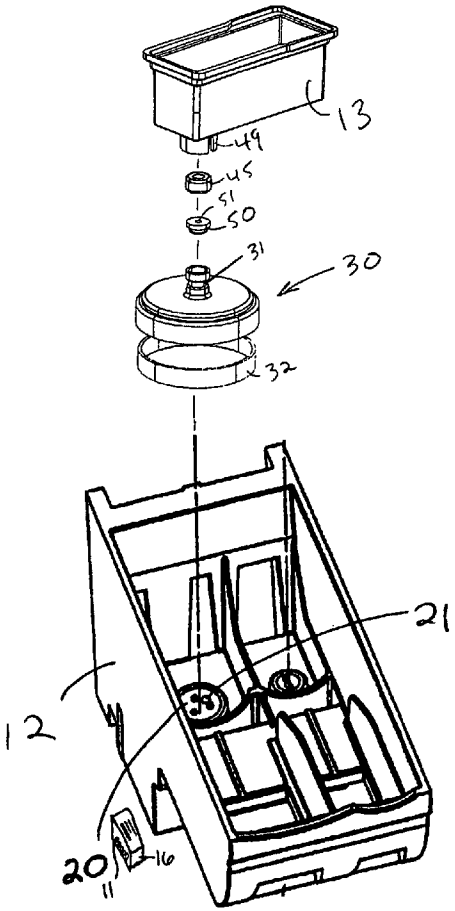
FIG. 5*a* is a perspective view of another example embodiment of an ink delivery system having a filter and cover assembly, which is made and operates in accordance with principles of the present invention.
Figure 5B:
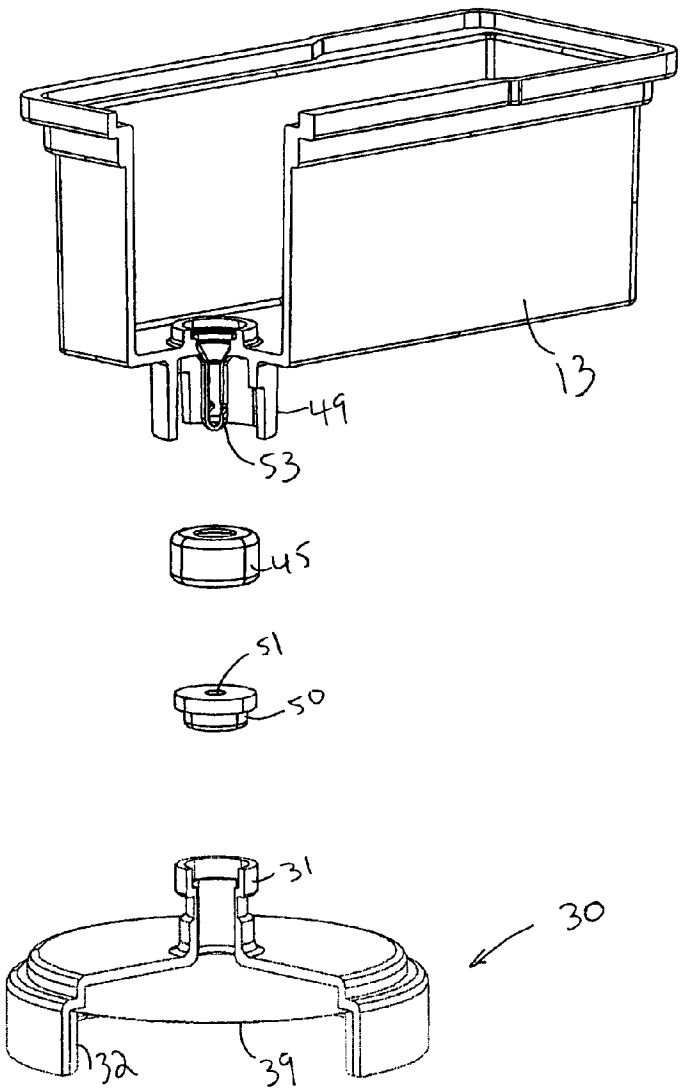
FIG. 5*b* is a cross-sectional view of the retainer and tank shown in FIG. 5*a*, which are made and operate in accordance with principles of the present invention.

FIG. 5*a* and FIG. 5*b* illustrate another example embodiment of an ink delivery system with a filter assembly, which is made and operates in accordance with a principle of the present invention. In this embodiment, a septum 50 is provided in the upper portion 31 of the retainer 30. The septum 50 can comprise any barrier member, and includes a small entry 51, such as a perforation, slit, pinhole, or resealable opening. The septum 50 may comprise an elastomeric material, or other sealing material, and can be formed or otherwise held within the upper portion 31 of the retainer 30. The septum 50 covers and protects the filter 39, which is held within the retainer 30. The septum 50 impedes air and contaminants from reaching the filter 39 when the ink tank 13 is not attached to the printhead body 12, and slows the drying time of residual ink on the filter 39, which prevents the filter 39 from clogging. The retainer 30 engages the printhead tower 20 of the printhead body 12, and an insert member 32 can abut the outer portion of the tower 20 and hold the filter 39 in place.

The tank 13 of this example includes a tower 49 in which resides a needle 53 having small ink flow passages formed therein. When the tank 13 engages the retainer 30, the tower 49 surrounds the outside of the retainer 30, and the interface between the needle 53 and the septum 50 provides a seal between the tank 13 and the retainer 30. In particular, the tower 49 of the tank 13 surrounds the upper pipe portion 31 of the retainer 30 and the needle 53 is inserted through the entry 51 in the septum 50. The size of the needle 53 and the septum entry 51 provide an interference fit, and the septum is made of a flexible material, such as an elastomer, such that a sealing engagement is achieved between the needle 52 and septum 50. The needle 53 enters the entry 51 in the septum 50 and thereby is able to provide ink to the filter 39 through the openings in the needle. In this embodiment, the diameter of the holes in the needle 53 are chosen to be small enough such that backpressure on the ink in the tank 13 is maintained when the tank 13 is disengaged from the printhead body 12, and to resist air infusion into the tank 13. Accordingly, a covering is not needed to protect the needle 53 when it is disengaged from the septum 50. When the ink tank 13 and retainer 30 are engaged, the ink is provided through the needle 53 to the filter 39, and the ink is then filtered by the filter 39 and provided to the tower 20 for supplying to the printhead chip 16. When the ink is expired from the tank 13, the tank can be removed by disengaging the tower 49 from the retainer 30 (causing the needle 53 to disengage the septum 50). The tank 13 can then be refilled or replaced by another tank having ink.

The foregoing description of various embodiments and principles of the inventions has been presented for the purposes of illustration and description. It is not intended to be exhaustive or to limit the inventions to the precise form disclosed. Many alternatives, modifications and variations will be apparent to those skilled in the art. For example, some principles of the invention may be used in different printhead configurations and types of printers. Moreover, although multiple inventive aspects have been presented, such aspects need not be utilized in combination, and various combinations of inventive aspects are possible in light of the various embodiments provided above. Accordingly, the above description is intended to embrace all possible alternatives, modifications, combinations, and variations that have been discussed or suggested herein, as well as all others that fall within the principles, spirit and broad scope of the inventions as defined by the claims.

What is claimed is:

1. A printhead assembly for an ink jet printer, comprising:

a printhead body having a tower portion, wherein the tower portion defines an ink entrance passage configured to receive ink from an ink tank;

a printhead chip provided on the printhead body and including ink ejection nozzles and ink ejectors, wherein the ink-ejection nozzles are in fluid communication with the entrance passage;

a retainer including a printhead end and a tank end, wherein the retainer is engaged with the tower portion of the printhead body at the printhead end, and wherein the retainer is configured to engage an exit structure on an ink tank at the tank end;

a filter fused within and to the retainer and positioned to filter ink moving downstream from an ink tank to the entrance passage; and a wick held by the retainer adjacent the filter and configured to allow ink to transfer from an ink tank to the filter, wherein the tower portion extends at least partially within an inner passage of the retainer and wherein the filter is disposed within the inner passage of the retainer upstream from the tower portion.

2. The assembly as recited in claim 1, wherein the filter is fused by insert molding the filter within the material of the retainer.

3. The assembly as recited in claim 1, wherein the wick extends between the filter and the tank end of the retainer.

4. The assembly as recited in claim 1, further comprising:

a sealing member positioned adjacent the retainer and configured to provide a fluid resistant seal between the retainer and an ink tank.

5. The assembly as recited in claim 1, further comprising a removable ink tank separable from the printhead body, wherein the retainer includes an extension portion engaged with an exit port of the tank.

6. The assembly as recited in claim 1, wherein the filter is fused by heat staking.

7. A printhead assembly for an ink jet printer, comprising:

a removable ink tank configured to hold ink and including an exit port configured to provide ink to a printhead;

a printhead body having a tower portion, wherein the tower portion defines an ink entrance passage configured to receive ink from the ink tank, wherein the printhead body and ink tank are separable from one another;

a printhead chip provided on the printhead body and including ink ejection nozzles and ink ejectors, wherein the ink ejection nozzles are in fluid communication with the entrance passage;

a retainer having a printhead end portion and a tank end portion, wherein the retainer is engaged with the tower portion of the printhead body at the printhead end portion and wherein the retainer is engaged with the exit port of the ink tank at the tank end portion, wherein the retainer includes an inner passage extending from the tank end portion to the printhead end portion and configured to permit passage of ink from the ink tank to the printhead body in a downstream direction;

a filter fused within and to the retainer; and a filter cover member held within the inner passage of the retainer between the tank end portion and the filter, wherein the filter cover member is configured to impede access to the filter from the tank end portion, wherein the tower portion extends at least partially within the inner passage of the retainer and wherein the filter is disposed within the inner passage of the retainer upstream from the tower portion.

8. The assembly as recited in claim 7, wherein the filter cover member comprises a wick extending between the filter and the exit structure of the tank.

9. The assembly as recited in claim 7, wherein the filter cover member comprises a septum and wherein the assembly further comprises a needle member in fluid communication with a reservoir in the ink tank and entering through the septum, to permit flow of ink from the ink tank to the tower portion.

10. The assembly as recited in claim 7, further comprising:

a sealing member positioned between the retainer and the ink tank and configured to provide a fluid resistant seal between the retainer and ink tank.

11. The assembly as recited in claim 10, wherein the sealing member comprises a gasket positioned about the retainer.

12. The assembly as recited in claim 7, wherein the retainer includes an extension portion engaged with the exit structure of the tank.

13. The assembly as recited in claim 7, wherein the filter is fused by insert molding the filter within the material of the retainer.

14. The system assembly as recited in claim 7, wherein the filter is fused by heat staking the filter to the retainer.

15. The assembly as recited in claim 7, wherein the diameter of the retainer at the printhead end portion is larger than the diameter of the retainer at the tank end portion.

16. A method of manufacturing a printhead assembly, comprising:

placing a filter over a printhead opening to the printhead body such that the filter edges extend past the edges of the printhead opening, wherein the printhead opening is in fluid communication with at least one printhead nozzle;

placing a retainer on the opening, the retainer including a printhead end and a tank end, wherein the retainer is engaged with a tower portion of the printhead body at the printhead end, and wherein the retainer is configured to engage an exit structure on an ink tank at the tank end;

fusing the filter within and to the retainer using heat, wherein the filter is positioned upstream from the tower portion to filter ink moving downstream from an ink tank to the entrance passage of the tower portion of the printhead body; and placing a cover in the retainer and adjacent the filter.

17. The method as recited in claim 16, wherein the printhead opening is defined by the tower portion.

18. The method as recited in claim 16, wherein the fusing process comprises insert injection molding the filter within the material of the retainer.

19. The method as recited in claim 16, wherein the cover comprises at least one of a wick and a septum.

20. The method as recited in claim 16, further comprising:

engaging an ink tank with the retainer, wherein the ink tank is removable and separable from the printhead body, and wherein the retainer provides a fluid connection between the ink tank and the printhead opening; and providing a gasket adjacent the retainer, wherein the gasket provides a seal between the retainer and the ink tank after the ink tank is engaged with the retainer.

21. A method of manufacturing a printhead assembly, the assembly including a printhead body having a tower portion, the method comprising:

forming a filter within a retainer by fusing the filter to the retainer using heat and without swaging the filter edges, wherein the filter is positioned upstream from the tower portion to filter ink moving downstream from an ink tank to the entrance passage of the tower portion of the printhead body;

placing the retainer including a printhead end and a tank end, on the printhead body, wherein the body defines an ink flow passage to a printhead chip; and engaging the retainer with a removable ink tank at the tank end and with the tower portion of the printhead body at the printhead end, wherein the ink tank is separable from the printhead body, and wherein the retainer provides a substantially sealed fluid passage between the ink tank and the printhead body.

22. The method as recited in claim 21, further comprising:

placing a filter cover in the retainer such that the cover substantially covers the filter.

23. The method as recited in claim 22, wherein the filter cover comprises at least one of wick and a septum.

24. The method as recited in claim 21, further comprising:

providing a gasket adjacent the retainer, wherein the gasket provides a seal between the retainer and the ink tank after the ink tank is engaged with the retainer.

25. The method as recited in claim 21, wherein the fusing process comprises at least one of a heat staking process and an insert injection molding process.

* * * * *